US007458131B2

(12) United States Patent
Yoo et al.

(10) Patent No.: US 7,458,131 B2
(45) Date of Patent: Dec. 2, 2008

(54) METHOD FOR DETERMINING FREQUENCY OF POWER BRUSH IN VACUUM CLEANER

(75) Inventors: Myung Keun Yoo, Kyungki-do (KR); Jun Young Lim, Inchun-si (KR); Yo Han Lee, Seoul (KR); Sang Young Kim, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 819 days.

(21) Appl. No.: 10/952,846

(22) Filed: Sep. 30, 2004

(65) Prior Publication Data

US 2005/0262660 A1 Dec. 1, 2005

(30) Foreign Application Priority Data

Jan. 16, 2004 (KR) ..... 10-2004-0003170

(51) Int. Cl.
*A47L 9/04* (2006.01)

(52) U.S. Cl. ..... 15/381; 15/389; 15/339

(58) Field of Classification Search ..... 15/381, 15/339, 389; *A47L 9/04*
See application file for complete search history.

(56) References Cited

U.S. PATENT DOCUMENTS

| | | | |
|---|---|---|---|
| 1,773,961 | A | 8/1930 | Dance |
| 2,836,940 | A | 6/1958 | Carmichael |
| 3,542,495 | A | 11/1970 | Barthalon |
| 4,430,768 | A | 2/1984 | Novinger |
| 5,901,411 | A | 5/1999 | Hato et al. |
| 2003/0037408 | A1 | 2/2003 | Park |

FOREIGN PATENT DOCUMENTS

| | | |
|---|---|---|
| CN | 1163740 | 11/1997 |
| DE | 2428400 | 1/1976 |
| EP | 0786228 | 7/1997 |
| GB | 1424764 | 2/1976 |
| JP | 3-272724 | 12/1991 |

OTHER PUBLICATIONS

English Language Abstract of JP 3-272724.
Gesellschaft fur Maschinendiagnose: "Fachbeitrag: Resonanz an Antrieben" Maschinendiagnose News, [Online] No. 03, 2000. pp. 1-4, download http://www.maschinendiagnose.de/Kundenzeitschrift/Zeit0003.pdf, Chapter "3 Resonanz;".

*Primary Examiner*—David A Redding
(74) *Attorney, Agent, or Firm*—Greenblum & Bernstein, P.L.C.

(57) ABSTRACT

Disclosed herein is a method for determining a frequency of a power brush in a vacuum cleaner. According to the method of the present invention, a mechanical oscillation frequency of a driving unit, which includes a brush body reciprocated within a range of prescribed angles, and a torsion bar for providing a prescribed elastic force to angular rotation of the brush body, is set equally to a driving frequency of a power supply unit, which drives the driving unit, or is set a prescribed percentage higher or lower than the driving frequency of the power supply unit, so that the driving unit can resonate. A large amount of movement is obtained using a small amount of power by means of the resonance.

20 Claims, 3 Drawing Sheets

METHOD FOR DETERMINING FREQUENCY OF POWER BRUSH IN VACUUM CLEANER

BACKGROUND OF THE INVENTION

1. Field of the Invention

The present invention relates to a power brush of a vacuum cleaner, and more particularly to a method for determining a frequency of a motor that drives a power brush of a vacuum cleaner.

2. Description of the Related Art

FIG. 1 is an exploded perspective view, in part, showing a suction head of a conventional vacuum cleaner.

As shown in FIG. 1, the suction head of the conventional vacuum cleaner comprises a head body 1 having a suction hole 2 for sucking waste off of the floor, and a brush unit 3 for raising waste from the floor to suck in the waste more efficiently through the suction hole 2.

The brush unit 3 comprises a brush body 4 rotatably mounted in the head body 1, a brush 5 attached to the surface of the brush body 4 such that ends of a plurality of brush parts constituting the brush 5 are implanted into the brush body 4, a power transmission part for rotating the brush body 4, and a motor 6 for driving the power transmission part.

The motor 6 drives the power transmission part, for example, a belt 7, by means of which the brush body 4 is rotated in one direction. The brush 5 contacts the waste on the floor by means of the rotating brush body 4. The waste contacting the brush 5 is introduced into the cleaner by means of air sucked in through the suction hole 2.

In the conventional method for raising the waste from the floor through the use of the brush 5 as described above, however, the power used to raise the waste from the floor is fully supplied from the motor 6 with the result that power consumption is high.

SUMMARY OF THE INVENTION

Therefore, the present invention has been made in view of the above problems, and it is an object of the present invention to provide a method for operating a vacuum cleaner that is capable of raising waste from the floor while power of a motor is used more efficiently.

In accordance with one aspect of the present invention, the above and other objects can be accomplished by the provision of a method for determining frequency of a power brush in a vacuum cleaner, wherein a mechanical oscillation frequency of a driving unit, the driving unit including a brush body reciprocated within a range of prescribed angles, and elastic means for providing a prescribed elastic force to angular rotation of the brush body, corresponds to a driving frequency of a power supply unit, the power supply unit driving the driving unit, so that the driving unit can resonate.

In accordance with another aspect of the present invention, there is provided a method for determining frequency of a power brush in a vacuum cleaner, wherein a mechanical oscillation frequency of a driving unit, the driving unit including a brush body reciprocated within a range of prescribed angles, and elastic means for providing a prescribed elastic force to angular rotation of the brush body, is set a prescribed percentage higher than a driving frequency of a power supply unit, the power supply unit driving the driving unit, so that vibration and noise due to introduced air generated depending upon a degree of contact of a suction hole of the vacuum cleaner can be reduced.

Preferably, the mechanical oscillation frequency of the driving unit is set 7 to 10% higher than the driving frequency of the power supply unit.

Preferably, the driving frequency of the power supply unit is 50 Hz, and the mechanical oscillation frequency of the driving unit is 53.5 Hz to 55 Hz.

Preferably, the driving frequency of the power supply unit is 60 Hz, and the mechanical oscillation frequency of the driving unit is 64.2 Hz to 66 Hz.

In accordance with yet another aspect of the present invention, there is provided a method for determining frequency of a power brush in a vacuum cleaner, wherein a mechanical oscillation frequency of a driving unit, the driving unit including a brush body reciprocated within a range of prescribed angles, and elastic means for providing a prescribed elastic force to angular rotation of the brush body, is set a prescribed percentage lower than a driving frequency of a power supply unit, the power supply unit driving the driving unit, so that vibration and noise due to introduced air generated depending upon a degree of contact of a suction hole of the vacuum cleaner can be reduced.

Preferably, the mechanical oscillation frequency of the driving unit is set 7 to 10% lower than the driving frequency of the power supply unit.

Preferably, the driving frequency of the power supply unit is 50 Hz, and the mechanical oscillation frequency of the driving unit is 45 Hz to 46.5 Hz.

Preferably, the driving frequency of the power supply unit is 60 Hz, and the mechanical oscillation frequency of the driving unit is 54 Hz to 55.8 Hz.

Preferably, the mechanical oscillation frequency of the driving unit is adjusted through the adjustment of at least one selected from a group including mass, density, and shape of the driving unit, and coefficient of elasticity, material, length, and diameter of the elastic means.

With a method for determining a frequency of a power brush in a vacuum cleaner according to the present invention, a large amount of movement can be obtained with a small amount of power through the use of resonance where the mechanical oscillation frequency of the driving unit corresponds to the driving frequency of the power supply unit.

Furthermore, the mechanical oscillation frequency of the driving unit can be set a prescribed percentage higher or lower than the driving frequency of the power supply unit according to the present invention, whereby noise and vibration is minimized while cleaning efficiency is maximized.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
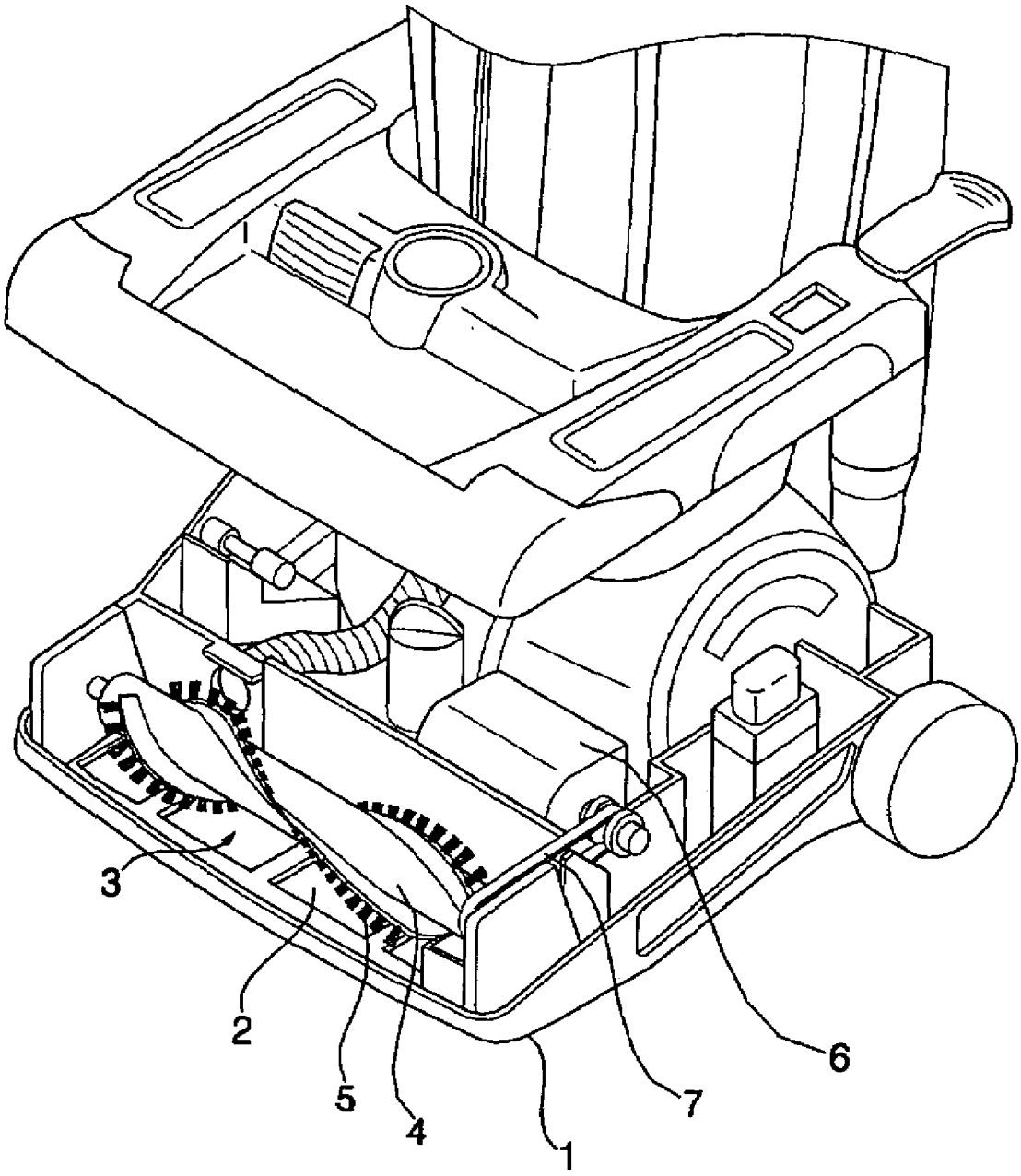
FIG. 1 (Prior Art)
FIG. 1 is a perspective view showing a suction head of a conventional vacuum cleaner.
Figure 2:
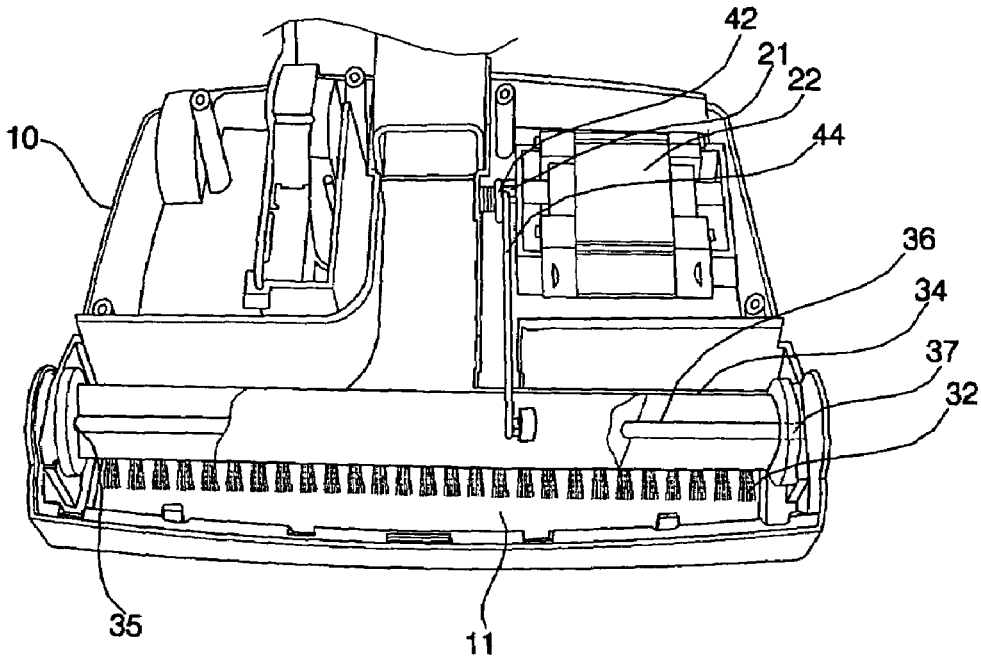
FIG. 2 is a perspective view showing the interior of a suction head of a vacuum cleaner according to a preferred embodiment of the present invention.
Figure 3:
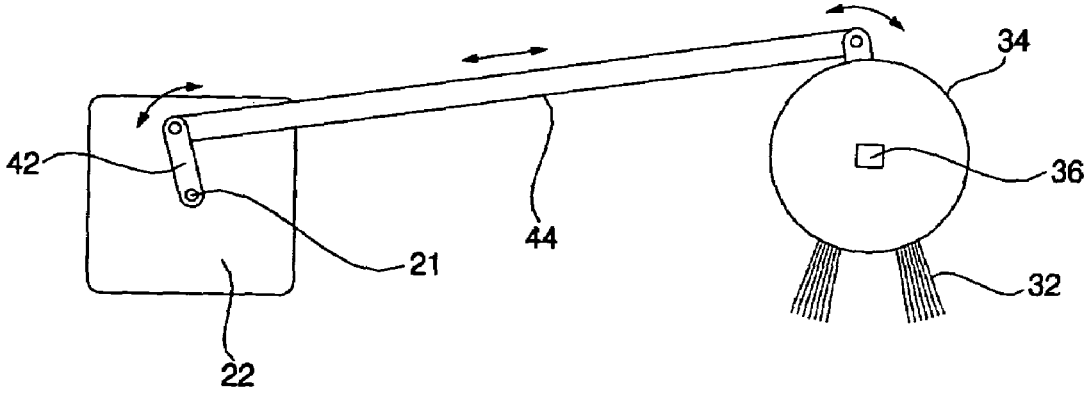
FIG. 3 is a side view schematically showing a power transmission part of the suction head shown in FIG. 2.
Figure 4:
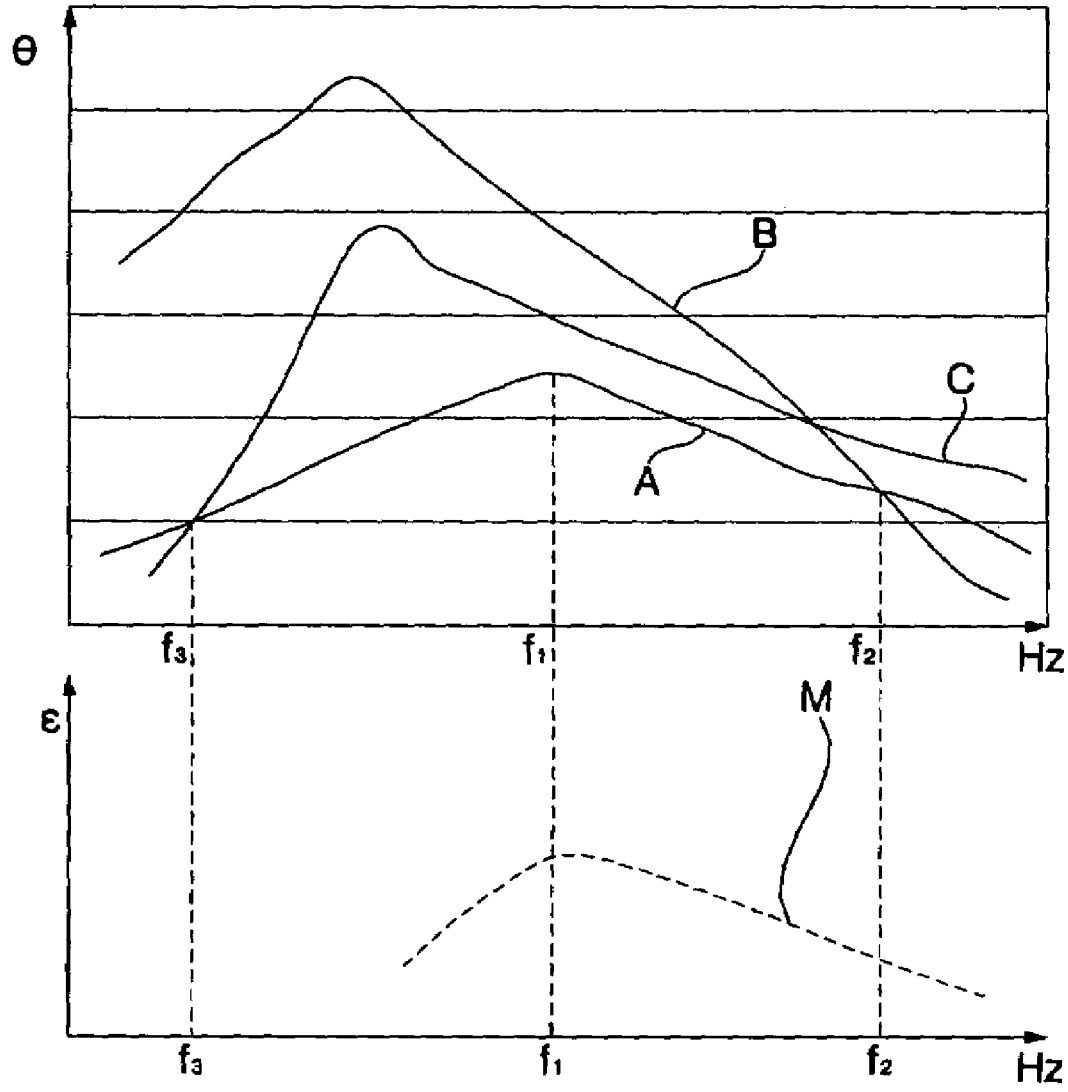
FIG. 4 is a graph illustrating rotating angles and efficiencies based on frequencies in the case that various external conditions are set to a power brush of the present invention.

FIG. 2 is a perspective view showing the interior of a suction head of a vacuum cleaner according to a preferred embodiment of the present invention, FIG. 3 is a side view schematically showing a power transmission part of the suction head shown in FIG. 2, and FIG. 4 is a graph illustrating experimental values of operating angles based on a driving frequency of a power brush of the present invention.

As shown in FIG. 2, the suction head of the vacuum cleaner according to the present invention comprises a head body 10 having a suction hole 11 formed therein, and a power brush attached to the head body 10.

The power brush comprises a power supply unit, and a driving unit driven by means of the power supply unit for raising waste from the floor.

Preferably, the power supply unit comprises a motor 22, which is driven by means of current applied to the motor 22.

The driving unit comprises a brush 32 contacting the waste on the floor for raising the waste from the floor, a brush body 34 on the surface of which the brush 32 is attached, a torsion bar 36 securely fixed to the insides of the head body 10 while extending through the brush body 34, and a power transmission part for driving the brush body 34 by means of the motor 22.

The brush body 34 is formed in the shape of a cylinder. The brush 32 is composed of a plurality of brush parts, ends of which are implanted into the lower part of the brush body 34 in line.

The torsion bar 36 is securely fixed to the brush body 34 while extending through the brush body 34. At least one of both ends 35 and 37 of the torsion bar 36 is securely fixed to the head body 10. In this embodiment, one end 35 of the torsion bar 36 is fixed to the head body 10, and the other end 37 of the torsion bar 36 is rotatably attached to the brush body 34.

As shown in FIG. 3, the motor 22 is driven by means of current applied to the motor 22. The motor 22 is driven at the same frequency as the frequency of the applied current. Specifically, a motor shaft 21 of the motor 22 is angularly rotated at a frequency of 50 Hz when the applied current has a frequency of 50 Hz. The motor shaft 21 of the motor 22 is angularly rotated at a frequency of 60 Hz when the applied current has a frequency of 60 Hz.

The power transmission part comprises an arm 42 angularly rotated by means of the motor shaft 21, which performs a reciprocating angular movement within a range of prescribed angles, and a link 44 connected to the arm for performing a reciprocating linear movement by a prescribed distance.

The arm 42 is securely fixed to the motor shaft 21. The link 44 is hinged to the arm 42 and the brush body 34. Consequently, the link 44 is linearly reciprocated a prescribed distance by means of the arm 42, which performs the reciprocating angular rotation. The brush body 34 is angularly rotated about the torsion bar 36 by means of the link hinged to the outside of the brush body 34.

The brush body 34 angularly rotated by means of the link 44 stores elastic force in the torsion bar 36. The brush body 34 collects the elastic force stored in the torsion bar 36 when the brush body 34 is returned to its original position. In other words, the brush body 34 accumulates an elastic force in the torsion bar 36, one end 35 of which is securely fixed to the brush body 34, whereby loss of energy is minimized.

The present invention as described above is characterized in that a frequency of the motor, at which the motor shaft 21 is angularly rotated, corresponds to a mechanical oscillation frequency of the driving unit, whereby a large amount of movement is obtained using a small amount of energy.

When it is required to set the frequency of the motor 22 and the mechanical oscillation frequency of the driving unit so that the frequency of the motor 22 and the mechanical oscillation frequency of the driving unit correspond to each other, it is efficient to adjust the mechanical oscillation frequency of the driving unit, since the frequency of the motor 22 is set to 50 Hz or 60 Hz, which is the frequency of commercially used current.

Factors that change the oscillation frequency of the driving unit may include mass, density, and shape. The mass moment of inertia of the driving unit may be changed through the modification of the mass, the density, and the shape.

Factors that change the oscillation frequency of the driving unit may include coefficient of elasticity, material, length, and diameter of the torsion bar 36. The spring constant of the torsion bar 36 may be changed through the adjustment of the coefficient of elasticity, the material, the length, and the diameter of the torsion bar 36.

In the power brush of the vacuum cleaner with the above-stated construction, resonance is generated through the correspondence of the frequency of the motor 22 to the mechanical oscillation frequency of the driving unit. As a result, noise and vibration are generated to some extent in the resonated driving unit.

FIG. 4 is a graph illustrating rotating angles based on frequencies in the case that various external conditions are set to the above-described power brush.

Pressure of air introduced through the suction hole 11 is changed depending upon how the suction head is placed on the floor. The curves A, B, and C of the graph shown in FIG. 4 are obtained on the basis of how the suction head is placed on the floor.

The curve A shows rotating angles based on frequencies when the suction head normally contacts the floor. The curves B and C respectively show rotating angles based on frequencies when the suction head is spaced apart from the floor.

More specifically, the suction head alternately contacts the floor and is detached from the floor while a user cleans the floor using a vacuum cleaner. The curve B shows the case where the suction head is completely spaced apart from the floor, and thus a large amount of air is introduced. The curve C shows the case where the suction head is spaced a prescribed distance from the floor, and thus a prescribed amount of air, which is more than the amount of the air in the case of the curve A but less than the amount of the air in the case of the curve B, is introduced.

The curve M shows efficiency of the motor 22 based on frequencies of the motor 22.

The power brush is operated most efficiently at a frequency f1 in the case of the curve A, where the cleaning operation is normally carried out. The frequency f1 is a frequency where the driving frequency of the motor 22 corresponds to the mechanical oscillation frequency of the driving unit.

Referring to the curves B and C at the frequency f1, on the other hand, the rotating angle of the power brush is shown considerably large. When the rotating angle of the power brush is considerably large, relatively large amount of vibration and noise are generated in the driving unit as compared to the normal curve A.

In the method for determining frequency of the power brush according to the present invention, therefore, frequencies f2 and f3, where vibration and noise are reduced, may be selected in addition to the frequency f1 at which the highest efficiency is provided.

Specifically, the frequencies f2 and f3, which are selected in addition to the frequency f1, are the optimum frequencies at which vibration and noise can be reduced by the use of resonance. The frequency f2 is a frequency where the curves A and B correspond to each other. The frequency f3 is a frequency where the curves A and C correspond to each other.

Especially, the frequency f2 or f3 is a frequency that is 7 to 10% higher or lower than the frequency f1.

Current inputted to the motor 22 is set to the commercial frequency, 50 Hz or 60 Hz. In the case that a frequency of the motor is set to the frequency f1 when the frequency of the motor 22 is 60 Hz, for example, the frequency f2 of the driving unit is set to between 64.2 and 66 Hz, and the frequency f3 is set to between 54 and 55.8 Hz.

In the case that a frequency of the motor is set to the frequency f1 when the frequency of the motor 22 is 50 Hz, on the other hand, the frequency f2 of the driving unit is set to between 53.5 and 55 Hz, and the frequency f3 is set to between 45 and 46.5 Hz.

According to the present invention, the frequency of the motor 22 and the oscillation frequency of the driving unit are intentionally set such that the frequency of the motor 22 corresponds to the oscillation frequency of the driving unit, in order to determine a frequency of the power brush.

It is also possible to set the mechanical oscillation frequencies f2 and f3 7 to 10% higher or lower than the resonant frequency so that the vibration and noise of the driving unit resonated by the above-mentioned intentional correspondence are reduced.

Consequently, a large amount of movement is obtained using a small amount of power at the resonant frequency or the frequency set a prescribed percentage higher or lower than the resonant frequency.

As apparent from the above description, the present invention provides a method for determining a frequency of a power brush in a vacuum cleaner that is capable of obtaining a large amount of movement with a small amount of power through the use of resonance where a mechanical oscillation frequency of a driving unit corresponds to a driving frequency of a power supply unit.

Furthermore, the mechanical oscillation frequency of the driving unit can be set a prescribed percentage higher or lower than the resonant frequency according to the present invention, thereby obtaining an optimum frequency having minimized noise and vibration.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A method for determining frequency of a power brush in a vacuum cleaner, wherein the frequency of the power brush is determined by a mechanical oscillation frequency of a driving unit, the driving unit comprising a brush body reciprocated within a range of prescribed angles and an elastic member which provides a prescribed elastic force to angular rotation of the brush body, and wherein the mechanical oscillation frequency corresponds to a driving frequency of a power supply unit, the power supply unit driving the driving unit such that the driving unit resonates.

2. The method as set forth in claim 1, wherein the mechanical oscillation frequency of the driving unit is adjusted through the adjustment of at least one selected from a group including mass, density, and shape of the driving unit, and coefficient of elasticity, material, length, and diameter of the elastic member.

3. The method as set forth in claim 1, wherein the driving frequency of the power supply unit is 50 Hz.

4. The method as set forth in claim 1, wherein the driving frequency of the power supply unit is 60 Hz.

5. A method for determining frequency of a power brush in a vacuum cleaner, wherein the frequency of the power brush is determined by a mechanical oscillation frequency of a driving unit, the driving unit comprising a brush body reciprocated within a range of prescribed angles and an elastic member which provides a prescribed elastic force to angular rotation of the brush body, and wherein the mechanical oscillation frequency is set a prescribed percentage higher than a driving frequency of a power supply unit, the power supply unit driving the driving unit, so that vibration and noise due to introduced air generated depending upon a degree of contact of a suction hole of the vacuum cleaner is reduced.

6. The method as set forth in claim 5, wherein the mechanical oscillation frequency of the driving unit is set 7 to 10% higher than the driving frequency of the power supply unit.

7. The method as set forth in claim 6, wherein the mechanical oscillation frequency of the driving unit is adjusted through the adjustment of at least one selected from a group including mass, density, and shape of the driving unit, and coefficient of elasticity, material, length, and diameter of the elastic member.

8. The method as set forth in claim 5, wherein the driving frequency of the power supply unit is 50 Hz.

9. The method as set forth in claim 8, wherein the mechanical oscillation frequency of the driving unit is 53.5 Hz to 55 Hz.

10. The method as set forth in claim 5, wherein the driving frequency of the power supply unit is 60 Hz.

11. The method as set forth in claim 10, wherein the mechanical oscillation frequency of the driving unit is 64.2 Hz to 66 Hz.

12. The method as set forth in claim 5, wherein the mechanical oscillation frequency of the driving unit is adjusted through the adjustment of at least one selected from a group including mass, density, and shape of the driving unit, and coefficient of elasticity, material, length, and diameter of the elastic member.

13. A method for determining frequency of a power brush in a vacuum cleaner, wherein the frequency of the power brush is determined by a mechanical oscillation frequency of a driving unit, the driving unit comprising a brush body reciprocated within a range of prescribed angles and an elastic member which provides a prescribed elastic force to angular rotation of the brush body, and wherein the mechanical oscillation frequency is set a prescribed percentage lower than a driving frequency of a power supply unit, the power supply unit driving the driving unit, so that vibration and noise due to introduced air generated depending upon a degree of contact of a suction hole of the vacuum cleaner is reduced.

14. The method as set forth in claim 13, wherein the mechanical oscillation frequency of the driving unit is set 7 to 10% lower than the driving frequency of the power supply unit.

15. The method as set forth in claim 14, wherein the mechanical oscillation frequency of the driving unit is adjusted through the adjustment of at least one selected from a group including mass, density, and shape of the driving unit, and coefficient of elasticity, material, length, and diameter of the elastic member.

16. The method as set forth in claim 13, wherein the driving frequency of the power supply unit is 50 Hz.

17. The method as set forth in claim 16, wherein the mechanical oscillation frequency of the driving unit is 45 Hz to 46.5 Hz.

18. The method as set forth in claim 13, wherein the driving frequency of the power supply unit is 60 Hz.

19. The method as set forth in claim 18, wherein the mechanical oscillation frequency of the driving unit is 54 Hz to 55.8 Hz.

20. The method as set forth in claim 13, wherein the mechanical oscillation frequency of the driving unit is adjusted through the adjustment of at least one selected from a group including mass, density, and shape of the driving unit, and coefficient of elasticity, material, length, and diameter of the elastic member.

* * * * *